US006221832B1

(12) United States Patent
Casteel et al.

(10) Patent No.: US 6,221,832 B1
(45) **Date of Patent: *Apr. 24, 2001**

(54) COMPACTED GRANULATE, PROCESS FOR MAKING SAME AND USE AS DISINTEGRATING AGENT FOR PRESSED DETERGENT TABLETS, CLEANING AGENT TABLETS FOR DISHWASHERS, WATER SOFTENING TABLETS OR SCOURING SALT TABLETS

(75) Inventors: Sascha Casteel, Aachen; Hans-Georg Hartan, Kevelaer; Elke Philippsen-Neu, Cologne; Rainer Poeschmann, Toenisvorst, all of (DE)

(73) Assignee: Stockhausen GmbH & Co. KG, Krefeld (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/438,660

(22) Filed: Nov. 12, 1999

(30) Foreign Application Priority Data

Nov. 11, 1998 (EP) ..... 98121392

(51) Int. Cl.[7] ..... C11D 3/22; C11D 3/37; C11D 11/00; C11D 17/06

(52) U.S. Cl. ..... 510/446; 510/224; 510/229; 510/230; 510/294; 510/298; 510/396; 510/473; 510/474; 510/477; 510/513; 252/175

(58) Field of Search ..... 510/224, 229, 510/230, 294, 298, 396, 446, 473, 474, 477, 513; 252/175

(56) References Cited

U.S. PATENT DOCUMENTS

| | | | | |
|---|---|---|---|---|
| 5,378,462 | | 1/1995 | Boedecker et al. | 424/94.29 |
| 5,382,377 | * | 1/1995 | Raehse et al. | 510/445 |
| 5,772,786 | * | 6/1998 | De Smet et al. | 134/25.2 |
| 5,900,399 | * | 5/1999 | Seiter et al. | 510/446 |

FOREIGN PATENT DOCUMENTS

| | | | |
|---|---|---|---|
| 960936 | | 1/1975 | (CA) . |
| 43 18 902 | | 12/1994 | (DE) . |
| 44 04 279 | | 8/1995 | (DE) . |
| 195 43 197 | | 5/1997 | (DE) . |
| 196 15 776 | | 10/1997 | (DE) . |
| 0552766 | | 7/1993 | (EP) . |
| 0 799 886 | | 10/1997 | (EP) . |
| 0 846 756 | | 6/1998 | (EP) . |
| 2 649 611 | | 7/1989 | (FR) . |
| 60-120810 | | 6/1985 | (JP) . |
| WO 94/05762 | | 3/1994 | (WO) . |
| 95/05449 | * | 2/1995 | (WO) . |
| 96/06156 | | 2/1996 | (WO) . |
| 98/40463 | | 9/1998 | (WO) . |
| WO 98/40463 | | 9/1998 | (WO) . |
| WO 99/13043 | | 3/1999 | (WO) . |

* cited by examiner

*Primary Examiner*—Lorna M. Douyon
(74) *Attorney, Agent, or Firm*—Oblon, Spivak, McClelland, Maier & Neustadt, P.C.

(57) ABSTRACT

Compacted granulate comprising starch and/or a starch derivatives and, optionally, water-swellable cellulose/cellulose derivatives, and finely divided polymers/copolymers of (meth)acrylic acid or salts thereof and one or more liquid surfactants, and the use thereof as disintegrating agent for detergent tablets, cleaning agent tablets, water-softening tablets and scouring salt-tablets, as well as a process for making the compacted granulate by mixing the constituents, granulating and compacting.

46 Claims, 1 Drawing Sheet

COMPACTED GRANULATE, PROCESS FOR MAKING SAME AND USE AS DISINTEGRATING AGENT FOR PRESSED DETERGENT TABLETS, CLEANING AGENT TABLETS FOR DISHWASHERS, WATER SOFTENING TABLETS OR SCOURING SALT TABLETS

BACKGROUND OF THE INVENTION

1. Field of the Invention

The present invention relates to a granulate which absorbs water particularly well and further transports water into the interior, thus leading in part to a volume increase, so that the granulate is suitable as a disintegrating agent for pressed molded bodies, such as tablets.

2. Discussion of the Background

Disintegrating agents for tablets or granulates are auxiliary substances which accelerate the disintegration of tablets or of the granulate on contact with liquids, especially water. The purpose is to bring about and accelerate both the disintegration of tablets into coarse fragments and then also disintegration into smaller particles.

Numerous inorganic and organic substances are known as disintegrating agents for tablets, examples including inorganic substances such as bentonites as well as per salts, acetates, alkali metal carbonates/bicarbonates and citric acid. The known organic compounds include starch, modified starch and starch decomposition products, cellulose, cellulose ethers such as methylcellulose, hydroxypropylcellulose and carboxymethylcellulose, poly(meth)acrylates, polyvinylpyrrolidone and cross-linked polyvinylpyrrolidone, alginates, gelatins and pectins.

In the case of tablets pressed from precompounded mixes, the need exists to accelerate disintegration into the original compounds and then also into individual constituents.

In the case of tablets pressed from non-precompounded mixes, the density achieved during pressing is frequently very high, and on contact with water it delays the desired disintegration of the tablets. This is often undesired, because constituents then dissolve only after a delay.

WO 98/40463 describes a disintegrating agent granulate and use thereof in molded bodies such as tablets having detergency or cleaning activity, where the granulate has a high adsorption capacity for water as well as a particle size distribution in which at least 90 wt % of the particles have a size of at least 0.2 mm and at most 3 mm. The granulate contains preferably 25 to 100 wt % of disintegrating agent such as starch, starch derivatives, cellulose, cellulose derivatives, alginic acid, carboxymethylamylopectin, polyacrylic acid, polyvinylpyrrolidone and polyvinylpolypyrrolidone. According to this publication, the presence of anionic or nonionic surfactants has an adverse effect on tablet disintegration time. The granulate is manufactured by a conventional method such as spray drying, superheated steam drying of aqueous formulations, or by granulation, tableting, extrusion or roll-compacting of powdered constituents.

A process for manufacture of detergent or cleaning agent tablets is described in WO 96/06156. Citric acid or citrates, bicarbonates and carbonates, bisulfate and percarbonate, microcrystalline cellulose, sugar, sorbitol or swellable layer silicates of the bentonite or smectite type are cited as disintegrating agents. The disintegrating agents are used in proportions of 1 to 25 wt % in the form of individual raw material or as compounds.

German Patent Application A 4404279 describes the following disintegrating agents for detergent or cleaning tablets: starch, starch derivatives, cellulose, cellulose derivatives, microcrystalline cellulose, salts of polymeric polyacrylates or polymethacrylates, methylcelluloses, hydroxypropylcelluloses or methylhydroxypropylcelluloses. Acetates or percarbonates are also cited as disintegrating agents. The applied proportions are as high as 15 wt %. Since water-soluble silicates are used as builders, even proportions as low as 1 wt % can lead to very good results with a combination of poly(meth)acrylates and nonionic cellulose ethers.

In European Patent Application EP 0846756 A1, tablet disintegrating agents are incorporated into the tablets and preferably into the outer solid shell of the tablets.

Combinations of soluble acids and alkali metal carbonates are preferably used. Further possible disintegrating agents can be found in the "Handbook of Pharmaceutical Excipients" (1986). Cited as examples are: starch (modified starch, sodium starch gluconates), gums (agar, guar and others), cellulose, carboxymethylcellulose, alginates, silicondioxide, clay, polyvinylpyrrolidone, polysaccharides and ion-exchange resins.

From European Patent Application EP A 0522766 there are known detergent tablets which contain disintegrating agents functioning according to four different mechanisms: swelling, porosity/capillary effect, deformation and chemical reaction. Described are starch, starch derivatives, carboxymethyl starch, sodium starch glycolates, cellulose and cellulose derivatives, carboxymethylcellulose, cross-linked modified cellulose, microcrystalline cellulose and various organic polymers such as polyethylene glycol, and cross-linked polyvinylpyrrolidones and inorganic swelling agents such as bentonites. Also described are combinations of organic acids and bicarbonates or carbonates of alkali metals.

European Patent Application EP 0628627 A1 describes a water-soluble, water-softening builder in the form of a tablet, in which combinations of citric acid and/or partly neutralized polymers and carbonate and/or bicarbonate or an insoluble polyvinylpyrrolidone are used as disintegrating agents.

European Patent Application (EP 0799886 A2) describes detergent tablets which can contain starch derivatives, cellulose compounds, polyvinyl-pyrrolidone compounds, polyvinylpolypyrrolidone compounds, bentonite compounds, alginates, gelatins and pectins as disintegrating agents. Addition of a polyfunctional organic carboxylic acid such as maleic acid, malic acid, citric acid or tartaric acid together with carbonates or bicarbonates is recommended for further improvement of dissolution time.

Available compositions do not contain any known disintegrating agent which is characterized by nonlinear swelling kinetics, and nowhere is there mentioned the use in disintegrating agents of surfactants, preferably gel-forming surfactants or surfactants which are thickened with water. Heretofore the prolongation of tablet disintegration time by certain surfactants has been described as a disadvantage.

SUMMARY OF THE INVENTION

It is an object of the present invention to provide a granulate which overcomes the drawbacks discusses above.

It is also an object of the present invention to provide a granulate which swells rapidly and strongly in water, so that it is suitable as a disintegrating agent for pressed molded bodies, especially tablets, in order to promote disintegration thereof on contact with water and to overcome the disadvantages described above, such as the prolongation of tablet disintegration time by anionic and nonionic surfactants.

The objects of the invention, and others, may be accomplished with a compacted granulate, comprising:

at least one starch and/or starch derivative, at least one finely divided polymer/copolymer of (meth) acrylic acid or a salt thereof, and at least one liquid surfactant which forms a gel or is thickened when contacted with water.

BRIEF DESCRIPTION OF THE FIGURES

A more complete appreciation of the invention and many of the attendant advantages thereof will be readily obtained as the same becomes better understood by reference to the following detailed description when considered in connection with the accompanying figures, wherein.

DETAILED DESCRIPTION OF THE INVENTION

Figure 1:
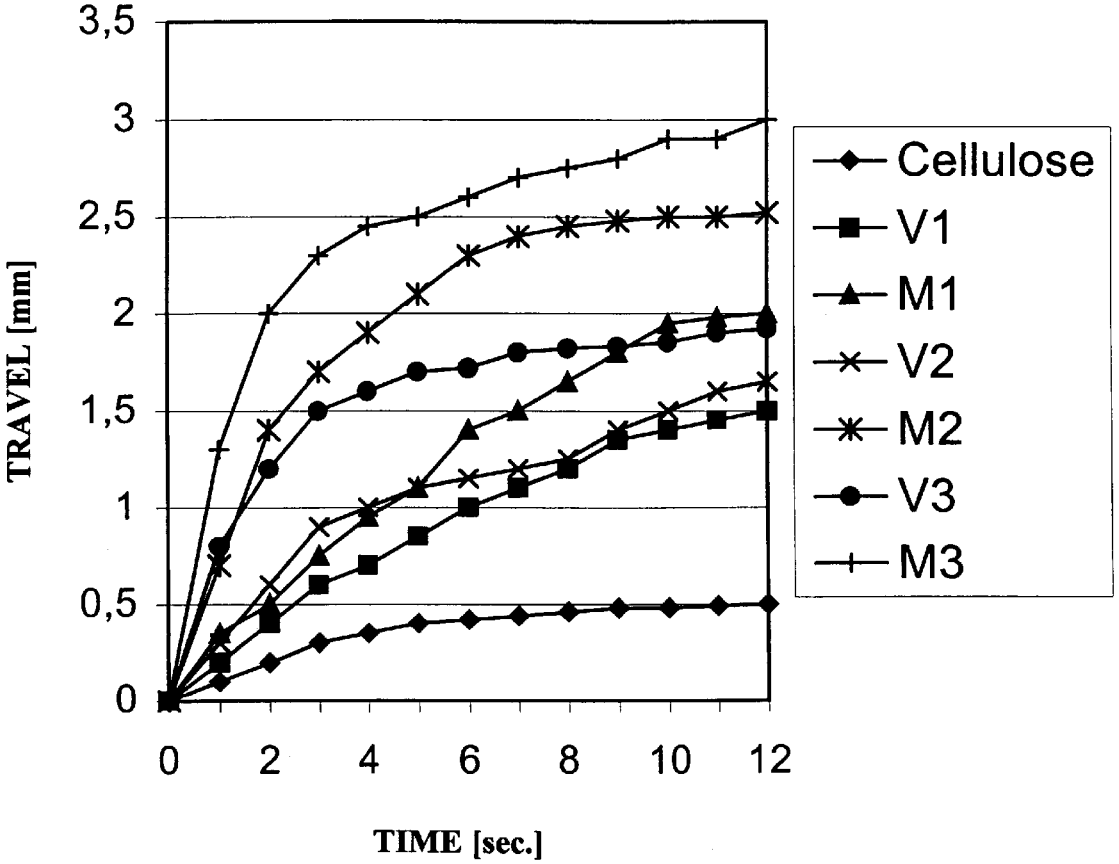
FIG. 1: diagram of the swelling kinetics of known disintegrating agents and of granulates prepared according to the present invention.

As used herein, the term "starch/starch derivatives" includes the group of polygalactomannanes.

In one embodiment of the invention, the starch/starch derivative is used in combination with a high-purity cellulose/cellulose derivative which swells in water.

Up to approximately 95 wt % of the starch can be replaced by cellulose and/or cellulose derivatives. Preferably the weight ratio of starch/starch derivative to cellulose/cellulose derivative ranges from 10:1 to 1:10, with weight ratios of 5:1 to 1:5 being especially preferred.

In the embodiment of the invention including the combination of starch/starch derivative and cellulose, the water-swellable, preferably high-purity cellulose is used in a form having microcrystalline microstructure, wherein the supermolecular structural elements have the form of fibrils, in the longitudinal direction of which crystalline and amorphous regions can alternate. Fibrils of native cellulose with a maximum length of 300 $\mu$m have proved particularly suitable. Both microcrystalline and amorphous, finely divided cellulose/cellulose derivatives and mixtures thereof can be used.

The finely divided cellulose preferably has apparent densities of 40 g/l to 300 g/l, and more preferably from 65 g/l to 170 g/l. If pre-granulated types are used, their apparent density will be higher and can range from 350 g/l to 550 g/l. The apparent densities of the starch/starch derivatives can be in the range of 50 g/l to 1000 g/l, preferably in the range of 100 g/l to 800 g/l.

The particle size of the finely divided cellulose can range between 30 $\mu$m and 200 $\mu$m; in the case of granulated types, the mean particle size ranges between 350 $\mu$m and 800 $\mu$m.

The polysaccharides of the starch/starch derivatives type to be used according to the invention can be of various origins, for example starch from rice, corn, wheat, potatoes and legumes. Even the corresponding flours with cellulosic plant constituents can be used.

Cold-swelling or cold-soluble starches are preferably used. Polygalactomannanes such as guar or carob bean flour already have this property in native condition and can be used directly or after slight modification.

Starches which do not swell naturally in cold water are preferably used in the form of their derivatives. Chemically derivatized starches preferably contain substituents which are linked in sufficient number to the polysaccharide chains by ester or ether groups, in order to bring about cold-water swellability.

Starches which have been modified with ionic substances such as carboxylate, hydroxyalkyl or phosphate groups have proved particularly advantageous in the present invention and are, therefore, preferred. Furthermore, cold-water-swelling starches of the degraded starch type can be used, examples being starches degraded by acid, enzymatic and oxidative action or dextrinized starches. It is often advantageous for swelling ability if the starch derivatives are modified by a combination of degradation and chemical substitution.

The use of slightly pre-cross-linked starches has also proved useful for improvement of swelling behavior. Starches treated with alkalis can also be used by virtue of their cold-water solubility.

Another group of cold-water-swellable starches which may be used in the present invention are the native starches, which have acquired cold-water swellability through physical treatment. They include, for example, extruded starches and drum-dried starches.

In combination with starch (derivatives) and possibly cellulose (derivatives), finely divided polymers of (meth) acrylic acid or copolymers of (meth)acrylic acid or salts thereof or mixtures of such polymers or copolymers or salts thereof with high water-absorption capacity are contained in the granulate. One or more of such polymers may be used. Linear polymers of (meth)acrylic acid, copolymers of (meth)acrylic acid or salts thereof with weight-average molecular weights of 5,000 to 70,000 and cross-linked polymers of (meth)acrylic acid, copolymers of (meth)acrylic acid or salts thereof with weight-average molecular weights of 1,000,000 to 5,000,000 have proved particularly suitable. These copolymers are preferably copolymers of (meth) acrylic acid and maleic acid or maleic anhydride which contain, for example, 40 to 90 wt % of (meth)acrylic acid and 60 to 10 wt % of maleic acid or maleic anhydride, whose relative molecular weight, based on free acid, ranges between 3,000 and 100,000, preferably 3,000 and 70,000 and especially preferably 5,000 and 50,000. Unless noted otherwise, all polymer molecular weights refer to weight-average molecular weights.

Terpolymeric and quaterpolymeric polycarboxylates synthesized from (meth)acrylic acid, maleic acid and vinyl alcohol or vinyl alcohol derivatives, or such from (meth) acrylic acid, sulfonic acids with ethylenic unsaturation and sugar derivatives, or such from (meth)acrylic acid, maleic acid, vinyl alcohol derivatives and monomers containing sulfonic acid groups also have proved highly suitable.

Salt formation takes place preferably with cations of alkali metals, ammonia and amines, or mixtures thereof, The finely divided polymers/copolymers of (meth)acrylic acid or salts thereof or cross-linked derivatives described in the foregoing preferably have a mean particle size of 45 $\mu$m to 150 $\mu$m. Especially preferred are particle sizes of 45 $\mu$m to 90 $\mu$m. These ranges include all specific values and subranges therebetween, such as 50, 60, 70, 80, 100, 110, 120, 130 and 140 $\mu$m.

Particles with mean particle sizes larger than 150 $\mu$m indeed have good disintegrating action, but are too large after swelling, become filtered out during washing and are visually evident as particles on the laundry after it has been washed.

Starch (derivatives) and possibly cellulose (derivatives) are combined with polymers/copolymers of (meth)acrylic acid or salts thereof in the granulate, the weight ratio may range from 100:0.5 to 100:30, preferably from 100:1 to 100:20, a weight ratio of 100:1 to 100:10 being especially preferred and a weight ratio of 100:3 being best of all.

The granulate also contains one or more liquid surfactants which form gels or become thick in the presence of water. The surfactant(s) may be selected from the group of nonionic, anionic or amphoteric surfactants.

The nonionic surfactants are selected from alkylpolyglucosides, fatty acid alkylolamides, fatty acid polyethylene glycol esters, fatty amine ethoxylates, fatty alcohol ethoxylates with 3 to 15 ethylene oxide or propylene oxide units, fatty acid glycerides, sorbitol esters, sucrose esters such as sucrose palmitate, pentaerythritol partial esters, which can also be ethoxylated, as well as alkylphenol polyethylene glycol ethers and phenol polyethylene glycol ethers (if these are permitted to be used under applicable regulations).

The anionic surfactants are selected from alkyl sulfates, linear and branched alkylbenzenesulfonates, alkyl glycerol ethers, fatty alcohol polyethylene glycol ether sulfates, paraffin sulfonates, alpha-olefin sulfonates, sulfosuccinates, phosphoric acid esters and fatty alcohol ether carboxylates.

The amphoteric surfactants are selected from coconut fatty acid amodipropylbetaine, modified imidazolines and fatty acid amide derivatives with betaine structure.

The quantitative ratio of starch (derivatives) and, optionally, cellulose (derivatives) and/or polymers/copolymers of (meth)acrylic acid or salts thereof to surfactant may range from 100:1 to 10:1. Quantitative ratios of 100:2 to 100:5 are preferred.

It was a completely surprising discovery that the swelling effect of the disintegrating agent granulates according to the invention is greatly improved by addition bonding of the surfactants according to the invention to starch (derivatives) and possibly cellulose (derivatives). This is particularly surprising since many concentrated surfactants tend to gel formation upon contact with water, suggesting that wetting and swelling of the disintegrating agent granulate should instead be hindered. For example, gel formation or thickening effects have been observed in the case of fatty alcohol ethoxylates. soaps, fatty alkyl ether sulfates and fatty alkyl sulfates.

The gel-forming surfactants or the surfactants which thicken with water can be anionic, amphoteric or nonionic, with nonionic surfactants being especially preferred.

It has therefore proved particularly advantageous first of all to bring the liquid surfactants into direct contact with the starch (derivatives) and possibly cellulose (derivatives) and to addition bond them thereto, and then to introduce the finely divided polymers/copolymers of (meth)acrylic acid or salts thereof into the mixture in such a way that the polymer particles adhere to the fibrils of the cellulose/starch (derivatives).

The mixture of the granulate constituents according to the invention, starch (derivatives) and, optionally, cellulose (derivatives) and polymers/copolymers of (meth)acrylic acid and nonionic surfactants is then granulated by standard processes. For example, mixers made by Vomm, Lödige, Schugi, Eihch, Henschel or Fukae may be used.

Final compaction is essential for the swelling and water-absorption behavior of the granulate according to the invention. Compaction by application of pressure can be achieved in various ways.

A particularly suitable process has proved to be compaction on roll mechanisms, whose rolls run with different rotational speeds, so that the compressive effect on the granulate in the gap between the rolls is further enhanced by friction. This leads to development of flaky structure and orientation of the starch (derivatives) and possibly anisotropic cellulose (derivatives) in the granulate.

Such orientation may be one of the reasons for the particularly favorable swelling kinetics of this embodiment of the granulates according to the invention.

The compaction of the granulate should preferably be such that the compacted granulate has an apparent density of 100 g/l to 800 g/l, preferably of 200 g/l to 600 g/l, especially preferably of 300 g/l to 500 g/l.

The disintegrating agent granulates according to the invention are contained in the molded bodies in proportions of 0.5 wt % to 10 wt %, preferably 2 wt % to 7 wt % and most preferably 3 wt % to 6 wt %.

The specific water-absorption capacity of the granulate according to the invention can be determined gravimetrically as follows:

A specified quantity of granulate (such as 2.00 g) is heat-sealed in a thin paper bag, such as a tea bag, and is immersed in a vessel containing excess water. After an immersion time of 3 minutes, the bag is removed from the water and suspended for 10 minutes to allow it to drip. The bag is weighed and the water absorption determined from the weight difference between wet bags with and without granulate. Distilled water or water with specified hardness can be used for the determination.

The water absorption that can be determined in this way ranges preferably from 500 to 2000%.

The granulate compacted according to the invention is characterized by special swelling kinetics, in which the expansion changes nonlinearly as a function of time and is intended to reach a certain level after the shortest possible time. The swelling behavior in the first 10 seconds after contact with water is especially of interest if the granulate is to be used as disintegrating agent for molded bodies.

Advantageously the volume increase after 5 seconds is 55 vol % to 225 vol %, the volume increase being greater at higher compaction, or in other words higher apparent density. After 10 seconds the volume increase is preferably 75 vol % to 270 vol %, the volume increase again being greater with increasing apparent density.

In the case of an apparent density of 250 g/l to 350 g/l, the volume increase ranges from 55 vol % to 100 vol % after 5 seconds of contact with water, and from 75 vol % to 130 vol % after 10 seconds. In the case of an apparent density of 400 g/l to 500 g/l, the volume increase ranges from 200 vol % to 225 vol % after 5 seconds and from 230 vol % to 270 vol % after 10 seconds.

To determine the swelling rate and the swelling height under load, 3.00 g of granulate is placed in a cylindrical plastic vessel with an inside diameter of 60 mm and covered with water-permeable nonwoven fabric. The thickness of the granulate layer is 1 to 3 mm, depending on apparent density. A movable plunger containing a through-hole and weighing 58 g is placed on the nonwoven fabric and connected with a displacement-measuring instrument, which records the travel of the plunger as a function of time. The granulate is caused to swell by addition of 50 ml of water, and the resulting displacement of the plunger (travel distance) is determined as a function of time and evaluated graphically, FIG. 1 shows a diagram of the swelling kinetics of known disintegrating agents and of granulates prepared according to the present invention.

Table 1 contains the corresponding measured values.

TABLE 1

Swelling kinetics of various materials

| Apparent density [g/l] Time [sec] | 70 Cellulose Travel [mm] | 90 V1 Travel [mm] | 90 M1 Travel [mm] | 300 V2 Travel [mm] | 300 M2 Travel [mm] | 450 V3 Travel [mm] | 450 M3 Travel [mm] |
|---|---|---|---|---|---|---|---|
| 0 | 0 | 0 | 0 | 0 | 0 | 0 | 0 |
| 1 | 0.10 | 0.20 | 0.35 | 0.30 | 0.70 | 0.80 | 1.30 |
| 2 | 0.20 | 0.40 | 0.50 | 0.60 | 1.40 | 1.20 | 2.00 |
| 3 | 0.30 | 0.60 | 0.75 | 0.90 | 1.70 | 1.50 | 2.30 |
| 4 | 0.35 | 0.70 | 0.95 | 1.00 | 1.90 | 1.60 | 2.45 |
| 5 | 0.40 | 0.85 | 1.10 | 1.10 | 2.10 | 1.70 | 2.50 |
| 6 | 0.42 | 1.00 | 1.40 | 1.15 | 2.30 | 1.72 | 2.60 |
| 7 | 0.44 | 1.10 | 1.50 | 1.20 | 2.40 | 1.80 | 2.70 |
| 8 | 0.46 | 1.20 | 1.65 | 1.25 | 2.45 | 1.82 | 2.75 |
| 9 | 0.48 | 1.35 | 1.80 | 1.40 | 2.48 | 1.83 | 2.80 |
| 10 | 0.48 | 1.40 | 1.95 | 1.50 | 2.50 | 1.85 | 2.90 |
| 11 | 0.49 | 1.45 | 1.98 | 1.60 | 2.50 | 1.90 | 2.90 |
| 12 | 0.50 | 1.50 | 2.00 | 1.65 | 2.52 | 1.92 | 3.00 |

The composition of Sample V1 to V3 is as listed in Table 3, Example 1.

The composition of Sample M1 to M3 is as listed in Table 3, Example 6.

TABLE 2

Volume expansion in vol %

| | Cellulose | V1 | M1 | V2 | M2 | V3 | M3 |
|---|---|---|---|---|---|---|---|
| Apparent density in g/l | 70 | 90 | 90 | 300 | 300 | 450 | 450 |
| Volume Increase: | | | | | | | |
| After 5 sec Vol. % | 5 | 14 | 18 | 61 | 110 | 210 | 240 |
| After 10 sec Vol. % | 6 | 23 | 35 | 83 | 140 | 242 | 270 |

Formulation V1 has the composition of Example 1 in uncompacted form. Formulation M1 has the composition of Example 6 in uncompacted form.

V2 and M2 denote specimens which were compacted to an apparent density of 300 g/l in a roll press after being mixed. V3 and M3 denote specimens which were compacted to an apparent density of 450 g/l by means of a roll press after being mixed.

The better performance of the compacted specimens is clearly evident, the volume increase after 5 sec preferably being at least 95% and especially preferably≧150%.

Further subject matter of the invention is also a process for manufacturing a compacted granulate which contains starch (derivatives) and possibly water-insoluble but water-swellable high-purity cellulose and finely divided polymers/copolymers of (meth)acrylic acid or salts thereof and one or more liquid surfactants, by mixing of starch (derivative) and possibly high-purity cellulose with the surfactant(s) and intermixing of the polymers/copolymers, granulation and subsequent compaction of the granulate together with orientation of the starch (derivatives) and possibly cellulose (derivatives).

The first step of the process comprises a mixing and granulation operation, in which precompounded mixes are made by agglomeration processes. These precompounded mixes form a free-flowing and coarse-grained product with a specified moisture percentage. In the next step, these precompounded mixes are mechanically compacted. The products can be compacted between two compression surfaces in roll compactors, which may be of smooth or profiled type, for example. If specified sliding properties exist, compaction to matrices can take place in extruders or presses with shallow cavity dies. The compacted product is ejected as a strand. Compaction methods in cavity dies with rams or cushioned rolls yield compacted products in the form of tablets or briquettes. Roll compactors, extruders, roll or cube presses as well as granulating presses can be used as compaction machines. Thereafter the coarse compacted particles are reduced in size, for which purpose mills, shredders or cylinder mills, for example, are suitable.

The granulate according to the invention absorbs water rapidly upon contact therewith and increases in volume, and so is suitable as a so-called disintegrating agent for pressed molded bodies, which can then disintegrate rapidly in water.

The invention includes the use of the compacted granulates as disintegrating agent for pressed molded bodies, such as tablets, cubes, spherical granules and similar shapes.

Especially preferred is the use as disintegrating agent for cleaning agent formulations, detergent formulations, scouring salts and water softeners in tablet or cube form.

Detergent tablets and cleaning agent tablets for different purposes, in sanitation or for dishwashers are known in principle.

Such molded bodies must have sufficient stability and strength in order to permit handling, packing and storage, but must also disintegrate rapidly on contact with water, so that the constituents can develop the desired action.

For this reason the pressed molded bodies frequently contain so-called disintegrating agents, which eliminate the cohesiveness of the molded bodies and accelerate disintegration by virtue of the swelling behavior and of the volume increase, Such detergent formulations made as molded bodies such as tablets usually contain builders, bleaching agents and bleach activators, surfactants, tableting auxiliary agents, disintegrating agents and further customary additives and auxiliary substances.

Builders include polyphosphates, pyrophosphates, metaphosphates or phosphonates, layer silicates, amorphous silicates, amorphous disilicates and zeolites. Further constituents of the builder system can be fillers such as alkali metal carbonates and bicarbonates such as sodium carbonate or sodium bicarbonate, sesquicarbonates, sodium sulfate, magnesium sulfate or citrate, citric acid, succinic acid, tartaric acid and malic acid. In many cases, co-builders and dispersants are also used as auxiliary builder. Such co-builders or dispersants can be polyacrylic acids and sodium salts thereof.

Copolymers of (meth)acrylic acid and maleic acid, terpolymers and quaterpolymers of (meth)acrylic acid, maleic acid, vinyl alcohol and sulfo-group-containing vinyl compounds can also be used.

Especially preferred are also terpolymeric and quaterpolymeric polycarboxylates synthesized from (meth)acrylic acid, maleic acid and vinyl alcohol or vinyl alcohol derivatives (as described in German Patent DE 4300772 C2) or such from (meth)acrylic acid, 2-alkylallylsulfonic acid and sugar derivatives (as described in German Patent DE 4221381 Cl) or such from (meth)acrylic acid, maleic acid, vinyl alcohol derivatives and monomers containing sulfonic acid groups (described in German Patent Application DE 19516957 A). Each of the German patents and patent applications cited above is incorporated herein by reference.

Polyethylene glycol and/or polypropylene glycol with a molecular weight of 900 to 30,000 are also suitable, as are carboxylated polysaccharides, polyaspartates and polyglutamate.

Mixtures with various organic builders such as citric acid are also possible.

Standard bleaching agents are sodium perborate tetrahydrate and sodium perborate monohydrate, sodium percarbonate, peroxy pyrophosphates, citrate perhydrates, peracid salts which release $H_2O_2$, per salts such as perbenzoates, peroxyphthalates, diperazelaic acid and diperdodecanoic diacids.

The content of bleaching agent in tablets is preferably 10 to 60 wt % and more preferably 15 to 50 wt %.

In order to achieve good bleaching action during washing at 60° C. and lower temperatures, activators can be incorporated. Suitable bleaching activators are the N-acyl and O-acyl compounds which form organic peracids with $H_2O_2$, preferably N,N'-tetraacylated diamines, carboxylic acid anhydrides and esters of polyols, such as glucose pentaacetate. Furthermore, acetylated mixtures of sorbitol and mannitol can be used. Especially suitable as bleaching activators are N,N,N',N'-tetraacetylethylenediamine (TAED), 1,5-diacetyl-2,4-dioxohexahydro-1,2,5-triazine (DADHT) and acetylated sorbitol-mannitol mixtures (SORMAN).

In addition to nonionic, anionic and amphoteric surfactants, cationic surfactants can also be present in detergent formulations, examples being quaternary ammonium compounds with $C_8$ to $C_{,16}$ N-alkyl or N-alkenyl groups and N-substituents such as methyl, hydroxyethyl and hydroxypropyl groups.

Polyalkylene glycols and magnesium stearate can be used as tableting auxiliary agents.

Examples of further standard detergent additives and auxiliary substances are enzymes, magnesium silicates, aluminum aluminates, benzotriazole, glycerol, magnesium stearate, polyalkylene glycols, hexametaphosphate, phosphonates, bentonites, soil release polymers and carboxymethylcelluloses.

Dishwasher tablets, which are one embodiment of cleaning agent formulations, usually contain as builders polyphosphates, pyrophosphates, metaphosphates or phosphonates, layer silicates, amorphous silicates, amorphous disilicates and zeolites, as well as fillers such as sodium carbonate, sodium sulfate, magnesium sulfate, sodium bicarbonate, citrate as well as citric acid, succinic acid, tartaric acid and malic acid. Co-builders and dispersants are frequently included as auxiliary builders. Such co-builders or dispersants can be polyacrylic acids or copolymers with polyacrylic acid and sodium salts thereof.

Standard bleaching agents are sodium perborate tetrahydrate and sodium perborate monohydrate, sodium percarbonate, peroxy pyrophosphates, citrate perhydrates, peracid salts which release $H_2O_2$, per salts such as perbenzoates, peroxyphthalates, diperazelaic acid and diperdodecanoic diacids. The content in tablets is preferably 10 to 60 wt % and especially 15 to 50 wt %.

Low-foam nonionic surfactants of the polyalkylene glycol and alkylpolyglucoside type are also used.

Examples of further standard detergent additives and auxiliary substances in this case also are enzymes, magnesium silicates, aluminum aluminates, benzotriazole, glycerol, magnesium stearate, polyalkylene glycols, hexametaphosphate and phosphonates.

Water-softening tablets usually comprise builders such as layer silicates, amorphous silicates, amorphous disilicates and zeolites, as well as fillers such as sodium carbonate, sodium sulfate, magnesium sulfate, sodium bicarbonate, citrate and citric acid. Co-builders and dispersants are frequently included as auxiliary builders. Such co-builders or dispersants can be polyacrylic acids or copolymers with polyacrylic acid and sodium salts thereof.

Low-foam nonionic surfactants of the polyalkylene glycol and alkylpolyglucoside type are also used.

Examples of further standard detergent additives and auxiliary substances are magnesium silicates, polyalkylene glycols and phosphonates.

EXAMPLES

Having generally described this invention, a further understanding can be obtained by reference to certain specific examples which are provided herein for purposes of illustration only and are not intended to be limiting unless otherwise specified. All values relate to weight unless otherwise indicated.

Examples 1 to 8

TABLE 3

Examples for disintegrating agent compositions according to the teaching of the patent (all proportions in wt %)[x].

| Example | 1 Comparison | 2 Comparison | 3 Comp. | 4 Comp. | 5 Comp. | 6 | 7 | 8 |
|---|---|---|---|---|---|---|---|---|
| Constituent: Cellulose[xx] | 80 | 50 | 80 | 48 | 85 | 70 | 80 | 55 |
| Linear PAA[v] | 20 | 5 | 10 | 5 | 12 | 8 | 8 | 10 |
| Cross-linked PAA[vi] | — | — | — | — | 1 | — | — | — |
| Carboxymethyl starch[vii] | — | — | — | — | — | — | 10 | — |
| Hydroxyethyl starch[vii] | — | — | — | — | — | — | — | 10 |
| Guar[vii] | — | — | — | — | — | 20 | 1 | — |
| Microcrystalline cellulose[xxx] | — | — | — | — | — | — | — | 23 |
| Nonionic surfactant[iv] | — | — | 10 | 5 | 2 | 2 | 2 | 2 |
| Water to 100% | — | 45 | — | 42 | — | — | — | — |

[x]% values relate to the commercial form of the components with the standard water content.
[xx]Cellulose with a fibril length of 150 μm.
[xxx]Microcrystalline cellulose with a particle size of about 200 μm.
[iv]Fatty alcohol surfactant (C12/14, EO = 4.7).
[v]Linear PAA with an average molecular weight of 40,000.
[vi]Cross-linked PAA with an average molecular weight of 2 million.
[vii]Commercial

Example 9

Phosphate-containing detergent tablets: Tablet strength and disintegration time using the granulates of the examples presented hereinabove:

Phosphate-containing detergent tablets with the composition described in Table 4 were tested as to their disintegration time and strength.

TABLE 4

Composition of detergent tablets:

| Raw Material | Proportion in % |
|---|---|
| Sodium tripolyphosphate | 35 |
| Sodium percarbonate | 19 |
| TAED | 4 |

TABLE 4-continued

| Composition of detergent tablets: | |
|---|---|
| Raw Material | Proportion in % |
| Fatty alcohol sulfate | 14 |
| Linear alkylbenzensulfonate | 4 |
| Sodium carbonate | 8 |
| Antifoaming agent, optical brightener, CMC; phosphonate | 6 |
| Microcrystalline cellulose (200 μm) | 2 |
| Enzyme Mix | 1 |
| Fatty alcohol ethoxylate (C12/14, EO = 4.7) | 2 |
| Disintegrating agent formation per Examples 1 to 8 | 5 |

Table 5 shows the strength and disintegration time of the individual detergent tablets with use of the various disintegrating agents:

TABLE 5

| Disintegrating agent composition per Example | Disintegration time in sec | Strength in N |
|---|---|---|
| 1 | 35 | 62 |
| 2 | 25 | 63 |
| 3 | 22 | 53 |
| 4 | 21 | 64 |
| 5 | 19 | 58 |
| 6 | 18 | 56 |
| 7 | 18 | 59 |
| 8 | 17 | 61 |

Example 10

Phosphate-free detergent tablets: Tablet strength and disintegration time using one of the granulates of the examples presented hereinabove:

10.1: Granulate from Example 6 in zeolite-based recipes

TABLE 6

| | Proportion in % | |
|---|---|---|
| Raw Material | a) | b) |
| Zeolite P | 39 | 35 |
| Fatty alcohol ethoxylate (C12/14, EO = 4.7) | 4 | 7 |
| Sodium percarbonate | 16 | 16 |
| TAED | 4 | 4 |
| Fatty alcohol sulfate | 10 | 11 |
| Linear alkylbenzenesulfonate | 3 | 3 |
| Sodium carbonate | 4 | 4 |
| Antifoaming agent, optical brightener, CMC, phosphonate | 5 | 5 |
| Enzyme Mix | 1 | 1 |
| Microcrystalline cellulose (200 μm) | 4 | 4 |
| Disintegrating agent formulation per Example 6 | 5 | 5 |
| Sodium citrate | 5 | 5 |

TABLE 6.1

| Recipe | Disintegration time in sec | Strength in N |
|---|---|---|
| a) | 30 | 59 |
| b) | 35 | 51 |

10.2: Granulate from Example 6 in disilicate-based recipes

TABLE 7

| | Proportion in % | |
|---|---|---|
| Raw Material | a) | b) |
| Amorphous disilicate | 36 | 30 |
| Fatty alcohol ethoxylate | 2 | 7 |
| Fatty alcohol sulfate | 11 | 15 |
| Linear alkylbenzenesulfonate | 4 | 2 |
| Sodium percarbonate | 16 | 16 |
| TAED | 4 | 4 |
| Acrylate-maleate copolymer | — | 3 |
| Sodium carbdnate | 7 | 4 |
| Sodium citrate | 5 | 5 |
| Microcrystalline cellulose (200 μm) | 4 | 4 |
| Antifoaming agent, optical brightener, CMC, phosphonate | 5 | 4 |
| Enzyme Mix | 1 | 1 |
| Disintegrating agent formulation per Example 6 | 5 | 5 |

TABLE 7.1

| Recipe | Disintegration time in sec | Strength in N |
|---|---|---|
| a) | 40 | 68 |
| b) | 15 | 48 |

Example 11

Pressed molded bodies with suitable for use as:

a) Scouring salt of the following composition:

TABLE 8

| Raw Material | Proportion in % |
|---|---|
| Co-granulate of sodium carbonate and disilicate | 20 |
| Sodium carbonate | 41 |
| Nonionic surfactant | 4 |
| TAED | 7 |
| Enzyme Mix | 1 |
| Sodium percarbonate | 24 |
| Disintegrating agent formulation per Example 4 | 3 |

b) Water softener of the following composition:

TABLE 9

| Composition of detergent tablets: | |
|---|---|
| Raw Material | Proportion in % |
| Zeolite | 15 |
| Sodium bicarbonate | 32 |
| Citric Acid | 20 |
| Polycarboxylate | 17 |
| Layer silicate | 8 |
| Process auxiliary agent | 5 |
| Disintegrating agent fonnulation per Example 7 | 3 |

c) Dishwashing machine cleaner of the following composition:

TABLE 10

| Raw Material | Proportion in % |
|---|---|
| Co-granulate of sodium carbonate and disilicate | 20 |
| Tripolyphosphate | 35 |
| Sodium carbonate | 20 |
| Sodium perborate | 12 |
| TAED | 4 |
| Enzyme Mix | 2 |
| Process Auxiliary Agent | 3 |
| Perfumes, colorants | 2 |
| Disintegrating agent formulation per Example 8 | 2 |

Results on the strength and disintegration time of the cleaning tablets

TABLE 11

| Physical parameters | Scouring salt per composition a) | Water softener per composition b) | Dishwashing machine per composition c) |
|---|---|---|---|
| Strength in N | 170 | 200 | 180 |
| Disintegration time without disintegrating agent | 224 s | 147 s | 240 s |
| Disintegration time with disintegrating agent | 100 s | 70 s | 60 s |

Obviously, numerous modifications and variations of the present invention are possible in light of the above teachings. It is therefore to be understood that within the scope of the appended claims, the invention may be practiced otherwise than as specifically described herein.

This application is based on European Patent Application Ser. No. 98 121 392.9, filed on Nov. 11, 1998, and incorporated herein by reference in its entirety.

What is claimed is:

1. A disintegrating agent in the form of a compacted granulate, comprising:

at least one starch and/or starch derivative, at least one finely divided polymer/copolymer of (meth) acrylic acid or a salt thereof, and at least one liquid surfactant which forms a gel or is thickened when contacted with water, wherein the weight ratio of the combined amount of the starch/starch derivative and the polymer/copolymer of (meth)acrylic acid to the liquid surfactant is 100:1 to 10:1, and wherein the disintegrating agent has an apparent densitv of 100 g/l to 800 g/l.

2. The disintegrating agent of claim 1, further comprising at least one water-insoluble but water-swellable high-purity cellulose and/or cellulose derivative.

3. The disintegrating agent of claim 2, wherein the high-purity cellulose or cellulose derivatives are anisotropic cellulose or anisotropic cellulose derivatives.

4. The disintegrating agent of claim 3, wherein orientation of the starch/starch derivatives and of the anisotropic cellulose or cellulose derivatives has been produced by compaction.

5. The disintegrating agent of claim 1, wherein the weight ratio of the combined amount of the starch/starch derivative and the polymer/copolymer of (meth)acrylic acid to the liquid surfactant is 100:2 to 100:5.

6. The disintegrating agent of claim 1, wherein the liquid surfactant is a nonionic and/or anionic and/or amphoteric surfactant.

7. The disintegrating agent of claim 2, wherein the weight ratio of the combined amount of the starch/starch derivative and the water-swellable high-purity cellulose/cellulose derivative and the polymer/copolymer of (meth)acrylic acid to the liquid surfactant is 100:1 to 10:1.

8. The disintegrating agent of claim 7, wherein the liquid surfactant is a nonionic and/or anionic and/or amphoteric surfactant.

9. The disintegrating agent of claim 1, comprising the starch/starch derivative and the finely divided polymer/copolymer of (meth)acrylic acid in a weight ratio of 100:0.5 to 100:30.

10. The disintegrating agent of claim 9, comprising the starch/starch derivative and the finely divided polymer/copolymer of (meth)acrylic acid in a weight ratio of 100:1 to 100:20.

11. The disintegrating agent of claim 10, comprising the starch/starch derivative and the finely divided polymer/copolymer of (meth)acrylic acid in a weight ratio of 100:1 to 100:10.

12. The disintegrating agent of claim 2, wherein the combined amount of the starch/starch derivative and the water-swellable high-purity cellulose/cellulose derivatives and the finely divided polymer/copolymer of (meth)acrylic acid are present in a weight ratio of 100:0.5 to 100:30.

13. The disintegrating agent of claim 12, wherein the combined amount of the starch/starch derivative and the water-swellable high-purity cellulose/cellulose derivative and finely divided polymer/copolymer of (meth)acrylic acid are present in a weight ratio of 100:1 to 100:20.

14. The disintegrating agent of claim 13, wherein the combined amount of the starch/starch derivative and the water-swellable high-purity cellulose/cellulose derivative and finely divided polymer/copolymer of (meth)acrylic acid are present in a weight ratio of 100:1 to 100:10.

15. The disintegrating agent of claim 2, wherein the weight ratio of the combined amount of the starch/starch derivative, the polymer/copolymer of (meth)acrylic acid, and water-insoluble but water-swellable high purity cellulose/cellulose derivative to the liquid surfactant is 100:2 to 100:5.

16. The disintegrating agent of claim 15, which has an apparent density of 200 g/l to 600 g/l.

17. The disintegrating agent of claim 16, which has an apparent density of 300 g/l to 500 g/l.

18. The disintegrating agent of claim 1, which has a specific water absorption of 500 to 2,000 wt %.

19. The disintegrating agent of claim 2, which has a specific water absorption of 500 to 2,000 wt %.

20. The disintegrating agent of claim 1, which exhibits nonlinear swelling kinetics.

21. The disintegrating agent of claim 2, which exhibits nonlinear swelling kinetics.

22. The disintegrating agent of claim 1, wherein the finely divided polymer/copolymer of (meth)acrylic acid are selected from the group consisting of linear polymers/copolymers of (meth)acrylic acid, cross-linked polymers/copolymers of (meth)acrylic acid, copolymers of (meth) acrylic acid and maleic acid, terpolymeric and quaterpolymeric copolymers synthesized from (meth) acrylic acid, maleic acid and vinyl alcohol or vinyl alcohol derivatives, or such from (meth)acrylic acid, sulfonic acids with ethylenic unsaturation and sugar derivatives, or such from (meth)acrylic acid, maleic acid or maleic anhydride, vinyl alcohol derivatives, monomers containing sulfonic acid groups, and mixtures thereof.

23. The disintegrating agent of claim 2, wherein the finely divided polymer/copolymer of (meth)acrylic acid are selected from the group consisting of linear polymers/copolymers of (meth)acrylic acid, cross-linked polymers/copolymers of (meth)acrylic acid, copolymers of (meth) acrylic acid and maleic acid, terpolymeric and quaterpolymeric copolymers synthesized from (meth) acrylic acid, maleic acid and vinyl alcohol or vinyl alcohol derivatives, or such from (meth)acrylic acid, sulfonic acids with ethylenic unsaturation and sugar derivatives, or such from (meth)acrylic acid, maleic acid or maleic anhydride, vinyl alcohol derivatives, monomers containing sulfonic acid groups, and mixtures thereof.

24. The disintegrating agent of claim 2, wherein the finely divided cellulose/cellulose derivative has a mean particle size of between 30 $\mu$m and 300 $\mu$m and/or an apparent density of 40 g/l to 300 g/l.

25. The disintegrating agent of claim 24, wherein the finely divided cellulose/cellulose derivative has a mean particle size of between 30 $\mu$m and 300 $\mu$m and/or an apparent density of 65 g/l to 170 g/l.

26. The disintegrating agent of claim 1, wherein the starch is selected from the group consisting of cold-water-soluble starches.

27. The disintegrating agent of claim 1, wherein the starch/starch derivative is chemically and/or physically modified starch.

28. The disintegrating agent of claim 27, wherein the starch is selected from the group consisting of galactomannanes, carboxymethyl starches, hydroxyethyl starches and dextrins.

29. The disintegrating agent of claim 2, wherein the starch is selected from the group consisting of cold-water-soluble starches.

30. The disintegrating agent of claim 2, wherein the starch/starch derivative is chemically and/or physically modified starch.

31. The disintegrating agent of claim 30, wherein the starch is selected from the group consisting of galactomannanes, carboxymethyl starches, hydroxyethyl starches and dextrins.

32. The disintegrating agent of claim 1, wherein the liquid surfactant is an anionic or nonionic surfactant selected from the group consisting of fatty alcohol ethoxylates with 3 to 15 ethylene oxide units, anions of fatty alcohol sulfate and linear alkylbenzenesulfonates, alkyl ether sulfates, and mixtures thereof.

33. The disintegrating agent of claim 2, wherein the liquid surfactant is an anionic or nonionic surfactant selected from the group consisting of fatty alcohol ethoxylates with 3 to 15 ethylene oxide units, anions of the fatty alcohol sulfate and linear alkylbenzenesulfonates, alkyl ether sulfates, and mixtures thereof.

34. A process for preparing the disintegrating agent of claim 1, comprising:

mixing the starch and/or starch derivatives and the surfactant, intermixing the finely divided polymer/copolymer of (meth)acrylic acid or a salt thereof, granulating to form a granulate, and compacting the granulate.

35. The process of claim 34, wherein granulate is compacted with rolls with friction, or a cube presses or extruder.

36. A process for preparing the disintegrating agent of claim 3, comprising:

mixing the starch and/or starch derivatives and the high-purity cellulose/cellulose derivative and the surfactant, intermixing the finely divided polymer/copolymer of (meth)acrylic acid or a salts thereof, granulating to form a granulate, and compacting the granulate, whereby orientation of the anisotropic cellulose or cellulose derivatives is produced.

37. The process of claim 36, wherein compaction takes place by means of rolls with friction thereof or cube presses or extruders.

38. A pressed detergent tablet comprising a detergent and 0.5 wt % to 10 wt %, relative to the total weight of the tablet, of the disintegrating agent of claim 1.

39. A pressed detergent tablet comprising a detergent and 0.5 wt % to 10 wt %, relative to the total weight of the tablet, of the disintegrating agent of claim 2.

40. A pressed cleaning agent tablet suitable for use in dishwashers, comprising a cleaning agent suitable for use in dishwashers and 0.5 wt % to 10 wt %, relative to the total weight of the tablet, of the disintegrating agent of claim 1.

41. A pressed cleaning agent tablet suitable for use in dishwashers, comprising a cleaning agent suitable for use in dishwashers and 0.5 wt % to 10 wt %, relative to the total weight of the tablet, of the disintegrating agent of claim 2.

42. A pressed water softening tablet comprising at least one water softening agent and 0.5 wt % to 10 wt %, relative to the total weight of the tablet, of the disintegrating agent of claim 1.

43. A pressed water softening tablet comprising at least one water softening agent and 0.5 wt % to 10 wt %, relative to the total weight of the tablet, of the disintegrating agent of claim 1.

44. A pressed scouring salt tablet comprising at least one customary constituent of scouring salt formulations and 0.5 wt % to 10 wt %, relative to the total weight of the tablet, of the disintegrating agent of claim 1.

45. A pressed scouring salt tablet comprising at least one customary constituent of scouring salt formulations and 0.5 wt % to 10 wt %, relative to the total weight of the tablet, of the disintegrating agent of claim 2.

46. The pressed scouring salt tablet of claim 45, which comprises 2 wt % to 7 wt %, relative to the total weight of the tablet, of the disintegrating agent.

* * * * *